United States Patent [19]

Gietman, Jr.

[11] Patent Number: 4,624,095

[45] Date of Patent: Nov. 25, 1986

[54] FOLDING AND PACKAGING SYSTEM

[75] Inventor: Peter J. Gietman, Jr., Combined Locks, Wis.

[73] Assignee: Custom Machinery Design, Inc., Appleton, Wis.

[21] Appl. No.: 736,267

[22] Filed: May 22, 1985

[51] Int. Cl.[4] ..... B65H 45/12

[52] U.S. Cl. ..... 53/117; 493/444; 493/450

[58] Field of Search ..... 53/117, 116, 429; 493/444, 440, 450, 458

[56] References Cited

U.S. PATENT DOCUMENTS

| | | | |
|---|---|---|---|
| 2,291,487 | 7/1942 | Myers | 493/444 X |
| 2,645,476 | 7/1953 | Wood et al. | 493/444 X |
| 3,363,897 | 1/1968 | Northern et al. | 493/444 X |
| 3,523,400 | 8/1970 | Daily | 53/117 |
| 3,905,593 | 9/1975 | Behn | 493/444 X |
| 3,918,698 | 11/1975 | Coast | 493/450 |

*Primary Examiner*—James F. Coan

*Attorney, Agent, or Firm*—John C. Cooper, III; Fred Wiviott

[57] ABSTRACT

A folder for sheets of pliable material, including bags, includes sets of conveying ropes and rollers to move the sheet from in-feed to discharge. One or more folding stations are provided, each of which includes a pneumatically-operated anvil with air holes which serves to create a fold in the material and change its direction of movement through the conveyor system. The final size of the product is determined by the number of folding steps employed. Control of the location of the fold, and hence the quality of the product is accomplished by control of the conveyor speed. An interrupt section is provided so that individual sheets of pliable material can be removed from perforated strips, e.g., in this production of garbage bags. Folded product is discharged into a pair of receiving trays, from which the product can be loaded into boxes or other packaging. In the preferred embodiment the folded product is alternately discharged through gates in the bottom of the trays, the discharge being assisted by an elongate ram which provides another fold to the stack and permits removal of the product from packaging in a one-at-a-time fashion.

32 Claims, 7 Drawing Figures

FOLDING AND PACKAGING SYSTEM

BACKGROUND OF THE INVENTION

1. Field of the Invention

The present invention relates generally to the art of folding and packaging sheets of pliable material, such as plastic or paper. The sheets may be multi-layer sheets, such as plastic bags. More specifically, the present invention relates to the art of accurately folding sheet material at a high rate of speed in a machine which may be readily modified to produce different types and sizes of products.

2. Description of the Prior Art

A number of different types of machines are known in the art for folding sheets of pliable material. Such sheet material includes paper sheets, such as tissue, and plastic sheets, such as bags. While a variety of such folded products are known, the prior art will be described, for purposes of illustration, by reference to the folding of plastic bags, such as trash bags, kitchen garbage bags, food storage bags, etc.

In the preparation of such products, plastic film tubing is typically sealed and perforated in a bag machine to produce connected bags. The bags are then separated from one another by tearing apart the perforations. In the commercially available folders known to the present inventor, the individual bags are then conveyed in a "lay flat" condition onto a table where the folding operations commence. In such known folders, the sheet is creased at a preselected location to form a fold as the sheet is pushed through an upper table onto a table below. Subsequent folding operations occur until a desired number of folds have been formed.

Several problems are encountered with such prior art folding machines. First, it has been difficult to correctly time the folding with the upstream operations, resulting in waste or poor quality product. Second, such machines are not quickly modified for different numbers of folds or different size products. Third, because speed is important in any folding and packaging operation, control of the orientation of the sheet material in such prior art machines has been a substantial problem. Such sheets may, at line speeds of over 150 feet per minute, have a tendency to become airborn as they move from bag machine to folding table. When this happens, the product can become improperly oriented, so that the folds will not be square to the edges of the product. Fourth, if the above problems are encountered and the folds are not square, the resulting product will be of poor quality. For example, the product will be larger than would be the case if all the folds were square. This problem is easily spotted upon examination of many commercial products found on store shelves at the present time. Moreover, if products are produced which are larger than desired, provision must be made to accommodate the larger products in the packaging. In the prior art, this has been accomplished by providing boxes which are larger than those which would be necessary for precisely folded products. Larger boxes add packaging material cost and additional expense in the transportation and display of the bag products.

A folding and packaging system which overcomes the aforementioned disadvantages of the prior art would represent a significant advance in the art.

OBJECTS AND SUMMARY OF THE INVENTION

It is a principal object of the present invention to provide a folding and packaging system for sheets of pliable material which overcome the aforementioned disadvantages of the prior art.

Another object of the present invention is to provide a folding and packaging system for sheets of pliable material which can be readily changed for products requiring different numbers of folds and/or for products of different sizes.

A still further object of the present invention is to provide a folding and packaging system for sheets of pliable material which includes a plurality of collectors for receiving the folded product.

A different object of the present invention is to provide a folding and packaging system for pliable material sheets which can be precisely coordinated with the upstream supply operation and which can readily be controlled to provide the fold or folds at preselected locations along the sheet as it is conveyed through the folder.

How these and other objects of the invention are accomplished will be described in the following specification, taken in conjunction with the drawings. Generally, however, they are accomplished in a folding and packaging machine which includes a system of conveyor rollers and ropes to grip the sheet material and convey it throughout the folder system. The machine is adapted to selectively direct product to a plurality of outlets, depending upon the number of folds which are required. The apparatus also includes a plurality of folding anvils which are movable from a first retracted position to a second extended position, the anvils each including air holes to assist in the folding process. The anvils are periodically extended to form folds and alter the path of the sheet material through the machine. The timing of the anvil extension can also be controlled so that the folds can be formed at any location along the material as it passes through the different parts of the folder. The line speed of the folder is coordinated throughout to coincide with the feed rate of the incoming material. If the incoming sheet material consists of connected perforated sheets, such as connected plastic bags, the machine includes an interrupt section to break the perforations. Once the folded product has been produced, it is discharged into one of a plurality of collectors which have an open top and a gate at the bottom. A movable slide is provided to direct the product to a preselected collector. If desired, a conveyor system brings boxes to receive the product below the collectors, and at the appropriate time, the bottom gate is opened and the product stack is pushed through the gate with an elongate ram element. The ram causes a further fold of the stack. If the boxes are loaded through the bottom, the product can be removed one-at-a-time from a tear-away opening provided in the top of the box. Other ways in which the objects of the invention are accomplished will become apparent after reading the following description of the preferred embodiment.

DESCRIPTION OF THE PREFERRED EMBODIMENT

Before proceeding to the detailed description of the preferred embodiment of the invention, it should be reiterated that the system of the present invention may be used for a variety of sizes and types of products. For example, the folder of the present invention may be used for folding and packaging garbage bags, such as those sold commercially in consumer packs of 20–50 bags, each having a capacity of 20–30 gallons or more. The present invention will be illustrated with reference to that kind of product. The apparatus of the invention can also be used for smaller products, such as sandwich or food storage bags or trash can liners, such as kitchen waste can liners. It may also be used for much larger products, such as yard and leaf bags, other sheet-type material such as ground covers, table cloths, and the like. Therefore, the dimensions of the apparatus of the invention, the number of folds, and the number of products produced per package can vary widely and be determined by those skilled in the art after the present specification has been read and understood. Finally, while the preferred embodiment of the invention involves the folding, stacking and packaging of plural items, the folding portion of the invention is well suited for the folding of individual items which may be separately packaged for sale to the ultimate consumer.

Figure 1:
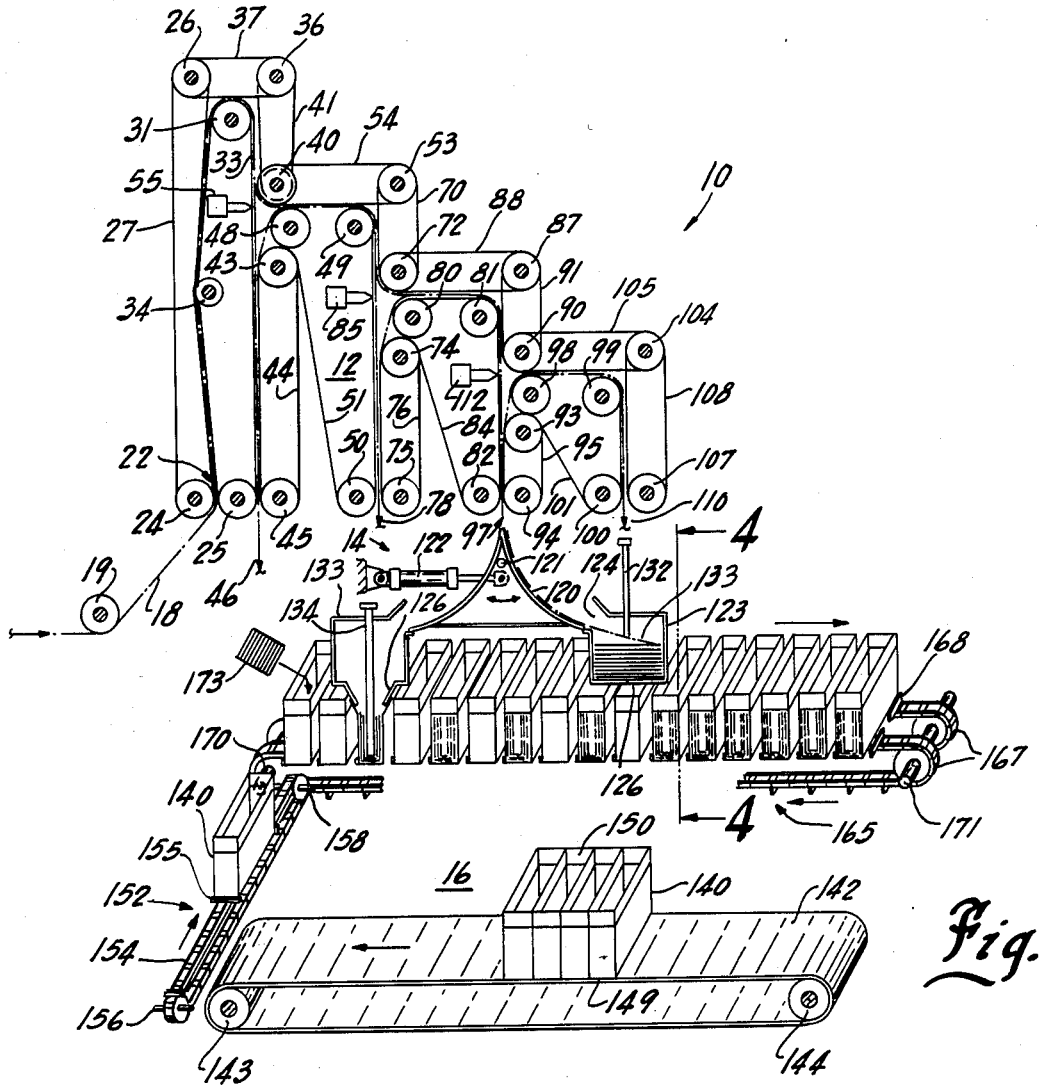
FIG. 1 is a schematic perspective illustration of the folding and packaging system according to the preferred embodiment of the present invention.

As an introduction to the description of FIG. 1, it should be mentioned that the feed material comprises a strip of connected garbage-type bags which have been prepared in any known type of bag making machine. One such machine is the rotary bag machine manufactured and sold by Custom Machinery Design, Inc. of Little Chute, Wis. Such bags are produced from a tube of plastic film, such as polyethylene film, and include a cross seal across the bottom of each bag. A perforation is formed adjacent the seal. It is also well-known that the bags produced on such bag making machines may be folded longitudinally, such as by passing the bags across folding boards, to reduce the width of the bag from an initial width of 33 to 36 inches, to about 8½ to 9 inches. In the present invention, such bags are separated from one another and folded transversely across the longitudinal folds, so that folded bags can be packaged in consumer-type packages.

Proceeding now to the description of FIG. 1, the folder and packager 10 of the present invention includes three major sections: a folding section 12, a collecting section 14 and a package conveyor section 16. The feed strip described above is shown entering the folder section 12 as strip 18. A roller 19 directs the film strip 18 into the apparatus 10. Roller 19 may be part of a dancer system (not shown) which acts to sense the tension in the incoming film and match the speed of the folding section to the output speed of the upstream bag making equipment. Many different types of dancer systems are known in the art and, in and of itself, roller 19 and its associated components (not shown) do not form part of the present invention.

The first component of folder 12 to receive the strip 18 is a pull roll nip section 22 which comprises a first pair of rollers 24 and 25. Rollers 24 and 25 should be at least as long as the width of incoming strip 18. Rollers 24 and 25 may be plastic or rubber covered and are driven through their shafts using gears, pulleys and the like. A roller 26 is located above roller 24 and is connected thereto by flexible connectors 27 so that the rollers will move at an identical speed while system 10 is in operation. In the preferred embodiment, the connectors 27 comprise a plurality of spaced-apart nylon elastic ropes which are received in annular grooves in the surfaces of rollers 24 and 26. While in the balance of this specification reference will repeatedly be made to spaced-apart ropes connecting various rollers, it will be readily appreciated by those skilled in the art that other endless, flexible connectors could be substituted for the ropes. Examples of other connectors include spaced-apart straps or belts. The advantages of using nylon, elastic ropes are primarily simplification of construction, cost reduction and ease of repair. The endless connectors will be referred to as ropes hereafter.

Adjoining the endless conveyor surface formed by rollers 24 and 26 and ropes 27 is another pair of rollers 25 and 31. As previously mentioned, roller 25 nips with roller 24, while roller 31 is located above roller 25. The axis of each of rollers 25 and 31 lie in a plane which is parallel to that formed by the axis of rollers 24 and 26. Ropes 33 surround rollers 25 and 31. It will be appreciated then that a film conveyor path is formed between the ropes of the two sets of rollers and that precise control of the location of the strip is maintained as it passes through this section. The ropes contact the strip along its length and at a plurality of locations across its width. Such control of bag location permits the machine to be run at very high speeds without fear of the film becoming airborn.

A film corrugating roller 34 may be provided within the endless conveyor formed by rollers 25 and 31 to insure that the incoming film is positively gripped by ropes 27 and 33. Roller 34 also insures that perforations between the bags in strip 18 are not broken until the perforation has passed this roller. The term "corrugating" is used to describe roller 34 because it pushes the two sets of ropes 27 and 33 together with the film pressed therebetween.

Another roller 36 is located at the level of roller 26 and spaced to the right thereof. Ropes 37 are provided between rollers 26 and 36 to provide a conveyor path which is at right angles to the initial path. Roller 31 is contacted by ropes 37 to effect a 90° change of direction in the strip 18 passing through this portion of the folder section 12.

Another roller 40 is located directly beneath roller 36 and is spaced apart therefrom, rollers 36 and 40 being connected by ropes 41. Ropes 41, together with the ropes 33, surrounding rollers 25 and 31 then form a downward conveyor path for the strip, which path is parallel to the inlet path. Another pair of spaced-apart rollers 43 and 45 are located beneath roller 40 and are connected by ropes 44. Roller 45 is located adjacent to but spaced apart from roller 25. The ropes 44 and the ropes 33 coupling rollers 25 and 31 then form another downwardly extending conveyor path which is parallel to the inlet path. A first outlet 46 from folder section 12 is located between rollers 25 and 45.

Located between and slightly to the right of rollers 40 and 43 is another roller 48. Roller 48 forms a nip with roller 40. A roller 49 is spaced horizontally to the right of roller 48 and another roller 50 is located directly below roller 49. These three rollers are connected by ropes 51. Yet, another roller 53 is spaced apart horizontally and to the right of roller 40 and is coupled thereto by ropes 54. From this description it will be apparent that a horizontal path is established between ropes 51 and 54.

Figure 3:
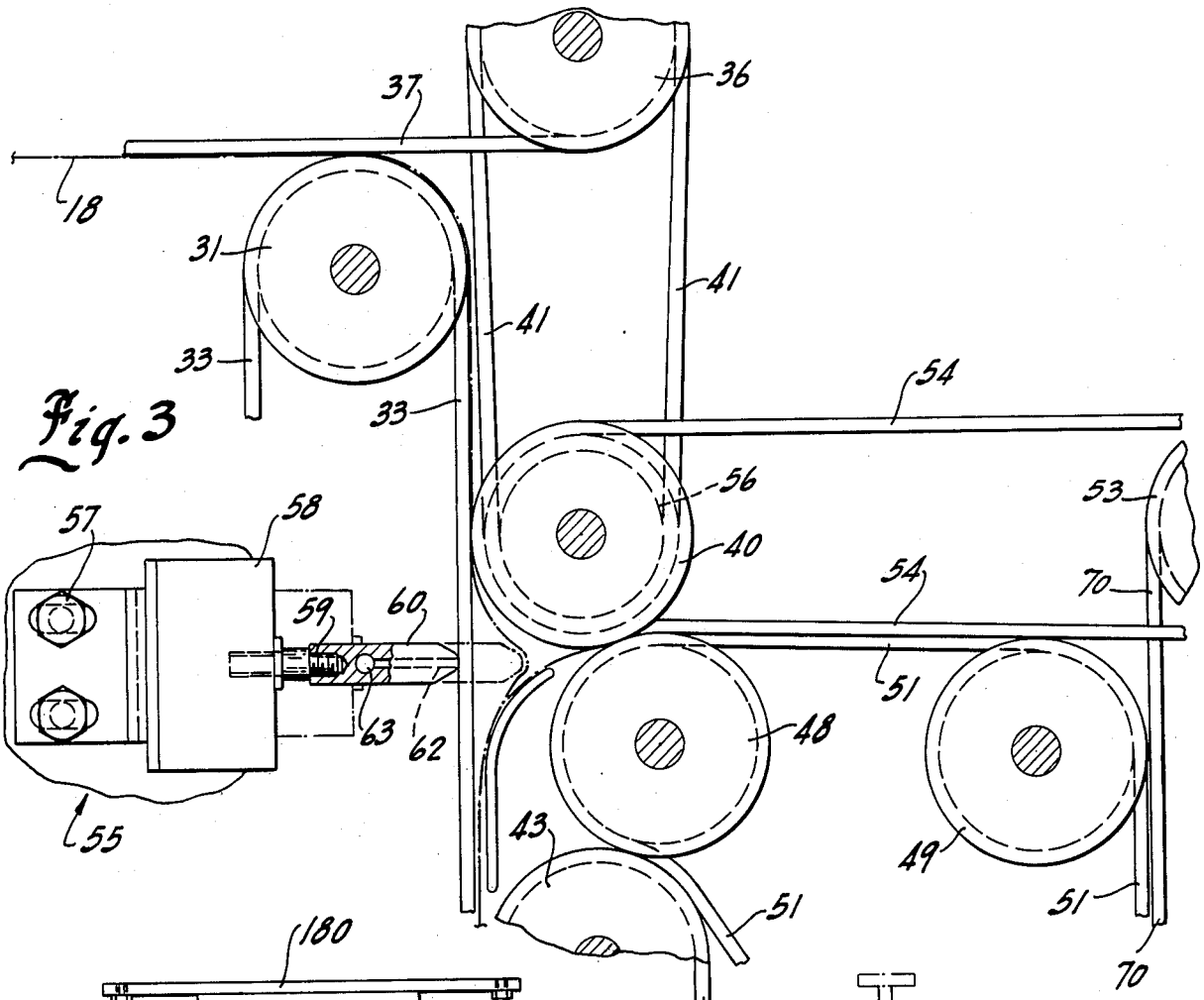
FIG. 3 is an exploded view illustrating in detail one of the folding anvil areas of the preferred embodiment of the invention.

Now that the first part of folder section 12 has been described, the method of forming a first transverse fold and the method of separating individual bags from strip 18 will be discussed. First, to effect the bag separation, the rollers 40 and 48 and all rollers downstream thereof are driven at a higher speed than the inlet rollers, e.g., by about 17%. The overspeed is created by the motor drive shown in FIG. 6. All portions of the machine, except the inlet portion, will operate at the same speed. The differential between the inlet line speed and the overspeed is accomplished by providing deeper grooves 56 in roller 40 for ropes 41 as illustrated in FIG. 3. The overspeed will cause a tearing of the perforation connecting the individual bags in strip 18 after the film enters the nip between rollers 40 and 48. Furthermore, from FIG. 1, it will be appreciated that when the bags are separated they will normally travel toward outlet 46 and past the folding anvil 55. If, for any reason, it is desired to collect the bags as individual bags with no transverse folds, the outlet 46 will be the outlet into the collection station 14 to be described later. If, however, it is desired to form a first transverse fold, the fold is formed at the nip of rollers 40 and 48 by a folding anvil 55. The anvil 55 is illustrated in greater detail in FIG. 3 and FIG. 7.

Anvil 55 is secured to the frame of folder section 12 by bolts 57 and includes a plurality (two in the preferred embodiment) of pneumatic, pancake-type cylinders 58, each of which includes a threaded piston rod 59 projecting therefrom. Slotted anvil blade 60 is secured to the piston rods, blade 60 including a longitudinal air manifold 63 and a plurality of passageways 62 extending from the manifold to the tip. A compressed air inlet port 64 is coupled to manifold 63 and to a source of compressed air (not shown). The slots 61 are provided in anvil 55 to allow the anvil tip to pass through ropes 33 when the anvil is extended.

From FIG. 3 it will be appreciated that when the piston rods 59 are extended, the tip of anvil 55 will approach the nip between rollers 40 and 48. It will further be appreciated that when the anvil is extended, it will initially crease the bag passing thereby, and that as air is expelled through the passageways 62, the air blast will assist in pushing the bags into the overspeed nip between rollers 40 and 48.

By further examination of FIG. 1 and FIG. 3, it will be seen that at the time a fold is formed by the anvil 55, the leading edge of a bag has passed by the anvil and nip roll section. When the crease and fold is formed, the transversely folded bag will be led into the downstream section of folder section 12 by the crease and will be followed by a longitudinally folded portion being drawn back up from the conveyor path established between ropes 44 and 33 and by the longitudinally folded portion approaching the anvil and nip roll section from the vicinity of the rollers 31 and 36. In actual practice the anvil extends about three-fourth inch to provide the desired creasing and air injection feature of the present invention.

In various product lines the location of the first transverse fold across the bag can vary. For some products it is desired to form the first fold in the middle of the longitudinally folded bag, while in others it may be desired to form the first transverse fold at one-third length, two-third length, etc. In the present invention, the timing of the first fold is selected by the machine operator utilizing a sequencing system. If the bags are being fed to apparatus 10 from a bag machine (as opposed to an unwind stand), the sequencing system is preferably initiated by a signal generator in the bag machine which indicates when each perforation is made. The generator will signal the completion of a bag. A first counter counts the number of bags and activates a second counter which measures the number of gear teeth mounted on the bag machine which have passed the counter. If, for example, the perforating knife of the bag machine uses a full revolution of a fly knife to form the perforation, and if the drive gear of the fly knife has 360 teeth, then the first counter will measure each complete revolution of the fly knife perforator and the second counter will measure each 1° revolution thereof. The second counter is programmed to trigger a solenoid valve (not shown) to initiate extension of the anvils 55 when a preselected number of counts has been reached. This allows the fold to be produced at any location along the bag length. The details of the counter and electrical system have not been described or illustrated in detail because a number of sequencing or timing systems could be used with apparatus 10, and those skilled in the art could readily devise a sequencing system for the folder section 10 after the present specification has been read and understood. What is important is providing some system to determine the positions of a bag at a particular time and to trigger the folding anvil 55 at the preselected time. It should also be appreciated that the extension of piston rods 59 and the blast of compressed air occur very quickly to allow the machine to run at very high speeds. For example, in the preferred embodiment of the present invention, the entering line speed may be 300 feet per minute or more. This speed would be for garbage-type bags and could be faster or slower depending on the particular type of product with which apparatus 10 is used.

The once folded bag enters the horizontal conveyor path established by ropes 51 and 54 and then enters a downwardly extending path established by ropes 51 and a new set of ropes 70 which connect roller 53 to a roller 72 located vertically below it. As was the case in the initial fold section (rollers 43 and 45), a pair of spaced-apart rollers 74 and 75 are located below roller 72 and are connected by ropes 76. An outlet 78 is provided between rollers 50 and 75.

A second, three-roller set is located in the second folding area of folder section 12. This set includes rollers 80, 81 and 82, joined by ropes 84. A second folding anvil 85 is provided in the vicinity of the nip formed by rollers 72 and 80. Another roller 87 is located to the right of roller 72 and is connected thereto by ropes 88.

It should be appreciated that the second section functions in the same manner as the first fold section described in detail above. From the illustration, it will also be apparent that some of the rollers are closer together and that some of the conveyor paths are shorter, all of which results from the fact that the overall bag length has been reduced by the first folding operation.

A third folding station is provided in the preferred embodiment of the invention by a third group of seven rollers which will now be described. The first of these rollers 90 is located below roller 87 and is spaced apart therefrom. Rollers 87 and 90 are connected by ropes 91. A pair of spaced-apart rollers 93 and 94 are disposed below roller 90 and are connected by ropes 95. An outlet 97 for twice-folded bags is then provided between rollers 82 and 94. The third fold is made possible by a third group of three rollers 98, 99 and 100, connected together by ropes 101 and arranged in a triangular fashion as was the case in the previous sections. This folding section is completed by a roller 104 spaced horizontally to the right of roller 90 and connected thereto by ropes 105 and by a roller 107 located below roller 104 and coupled thereto by ropes 108. The outlet 110 for bags which have been folded three times is provided between rollers 100 and 107. A third folding anvil 112, similar in all respects to anvils 55 and 85, is located near the nip of rollers 90 and 98 to crease the twice-folded bags and push the bag by compressed air into the nip between rollers 90 and 98. Furthermore, as explained above, some of the rollers are located even closer together in the third folding section and some of the conveyor paths are shorter, all because the bags have been reduced further in length in the second folding section.

Figure 6:
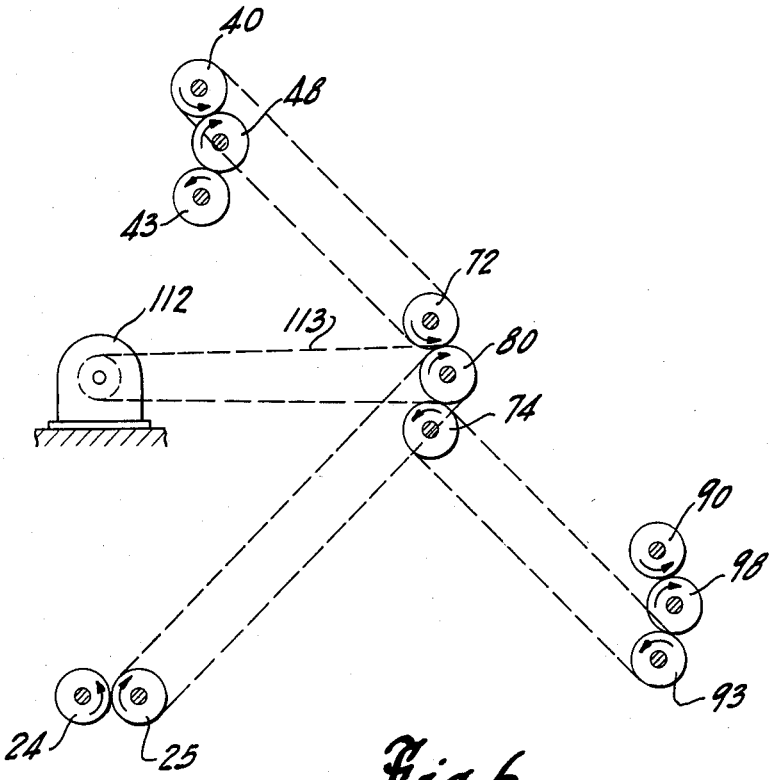
FIG. 6 is a schematic illustration of the roller drive system of the preferred embodiment of the present invention.
Figure 7:
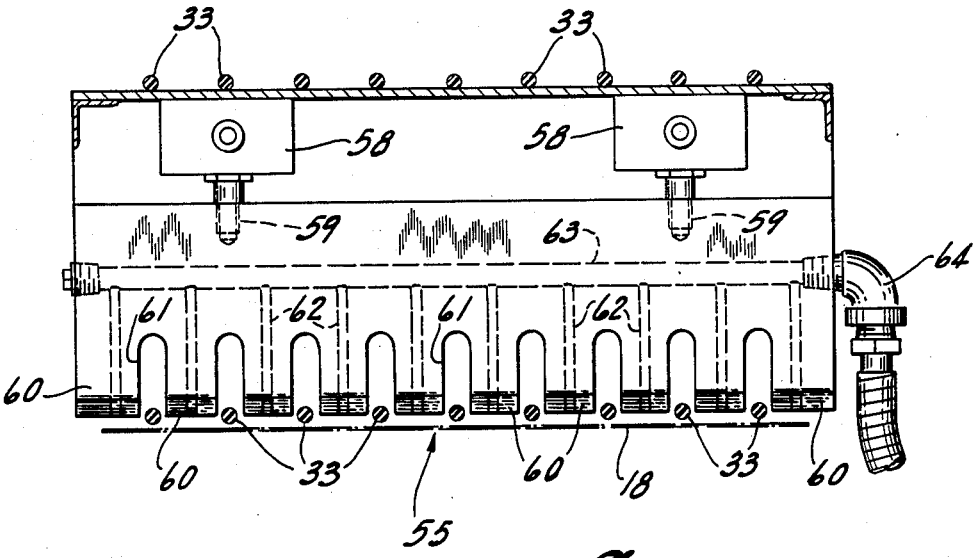
FIG. 7 is a top plan view illustrating a folding anvil of the preferred embodiment of the present invention.

As illustrated in FIG. 6, only four of the rollers need to be driven by a motor 112 to accomplish all derived conveyor movement in section 12. This is possible because of the nip formed between certain of the rollers (the shafts of which are connected by gears to one another) and the fact that the remaining rollers are coupled to the driven rollers by the ropes. The drive system can be varied by connecting its drive belts 113 to other rollers in the cluster as will be understood by those skilled in the art.

As previously indicated, bags from folder section 12 can exit apparatus 10 through any one of the outlets 46, 78, 97 or 110 and be collected in a collection section 14. In the preferred embodiment, this is accomplished by providing a pivotable slide 120 which is positioned below a selected one of the outlets (in FIG. 1, below outlet 97). Slide 120 is generally triangular in cross section and includes a pivot point 121. A cylinder 122 is located adjacent slide 120 and is adapted to pivot the upper tip thereof to one side or the other of an outlet.

When in a first position, the slide 120 is adapted to direct bags into a first collector 123. Collector 123 is a four-sided container having an inlet 124 at the top and four side walls which are sized for the particular type of bag product being prepared. The bottom of collector 123 includes a pair of swinging gate doors 126 which are spring-loaded in such a fashion that the bottom of collector 123 is normally closed. The folded bags slide into the collector 123 and align themselves as they settle toward the bottom of collector 123. A sufficient number of bags 130 will be introduced into collector 123 to fill one package, and at that point, determined by any suitable type of counter (not shown), the slide 120 will be pivoted to its alternate position.

In its alternate position, slide 120 will feed bags to a second collector 133 which is a mirror image of collector 120 (with respect to the inlet opening). The illustration of collector 133 in FIG. 1 shows the doors 126 in their lower or open position.

The final feature of collecting section 14 to be described is a pair of pusher blades 132 and 134. Blade 132 is in the up position and is located above the stack of bags being collected in collector 123. Blade 134, on the other hand, is illustrated in its lower position, i.e., the position in which bags 130 are forced by blade 134 into a packaging container or box 140. We will return to a more detailed description of the loading of such containers in a later portion of the specification.

Figure 2:
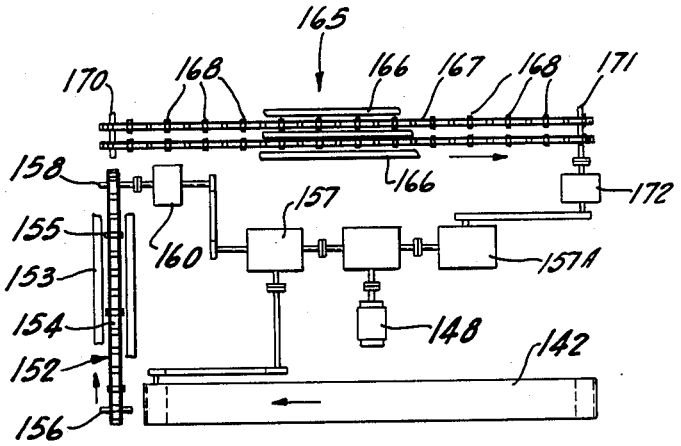
FIG. 2 is a schematic top plan view of the conveyor system of the preferred embodiment of the invention.

Conveyor section 16 will next be described with reference to FIG. 1 and 2. Conveyor section 16 includes three separate conveyors. The first is an endless belt 142 wrapped around a pair of rollers 143 and 144, roller 143 being continuously driven from a motor 148 through a gear box 157. Belt 142 is provided to receive open boxes 140. For purposes of this explanation, it may be assumed that boxes 140 are typical of those presently used to package folded bags, i.e., they have a perforated tear-away section (not shown) on their top 149. In the present invention, top 149 is placed on the conveyor. Box 140 also includes bottom flaps 150 which are open to receive the bags from collector section 14.

The boxes from conveyor 142 are transferred to a second conveyor 152 which is an indexing conveyor and which, in the illustrated embodiment, runs at right angles to conveyor 142. The conveyor 152 includes a pair of spaced-apart surface support plates 153, between and below which an endless chain 154 is provided. L-shaped members 155 are attached to the chain and protrude through plates 153 at distances which corresponds to the length of containers 140. The chain passes around sprockets on shafts 156 and 158. Shaft 157 is driven by motor 148 through the gear box 157, and a clutch 160 is provided to index conveyor 152 when an opening is made available on the third conveyor 165 now to be described.

Conveyor 165 runs parallel to but in the opposite direction to conveyor 142. It includes three spaced-apart surface support plates 166. A double run of chain 167 is provided between plates 166, the chains having attached thereto L-shaped members 168 which protrude through plates 166 at intervals corresponding to the width of container 140. The chains are endless and pass around sprockets mounted on shafts 170 and 171. Shaft 171 is also driven through motor 148, a second gear reducer 157A and a clutch 172 to provide indexing when required. From the illustration it will be appreciated that the rectangular boxes 140 are moved sideways on conveyors 142 and 155 and lengthwise in conveyor 152. This particular arrangement, however, is not critical to the invention. The clutches insure that as one box is filled, an empty box is provided to the system. In practice, alternate boxes are loaded by collectors 133 and 123. Also illustrated in FIG. 1 is the addition of bag ties 173 to the empty boxes as is known in the art for this type of product. The ties can be added by hand or any suitable apparatus. Furthermore, the flaps 150 are closed in any known fashion to provide the completely packaged products. The individual boxes will typically be loaded in corrugated containers for shipment to the retail outlet.

Figure 4:
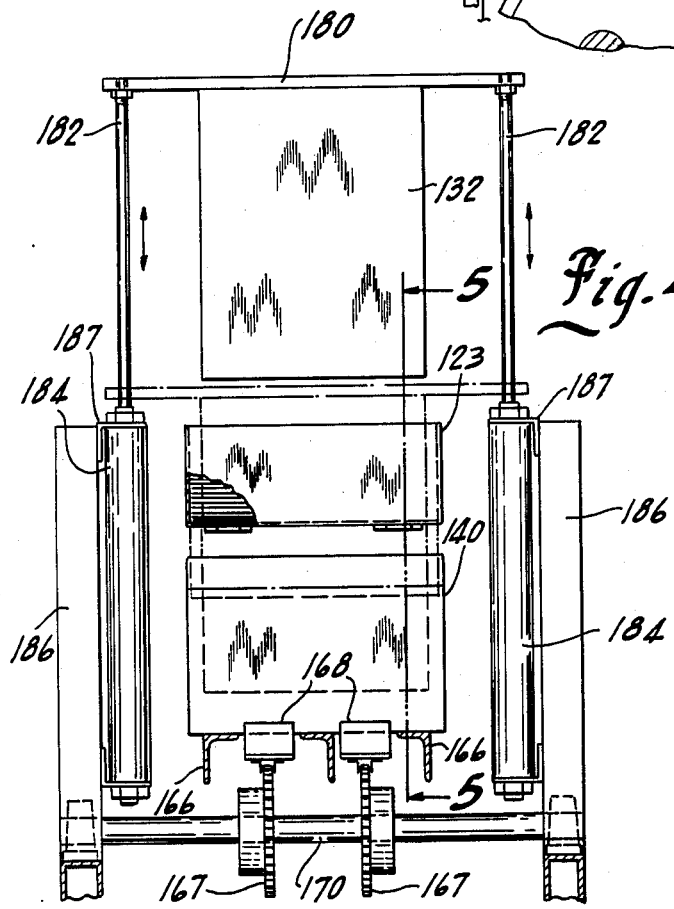
FIG. 4 is a view taken along the line 4—4 of FIG. 1 and illustrating a collector of the preferred embodiment of the invention.
Figure 5:
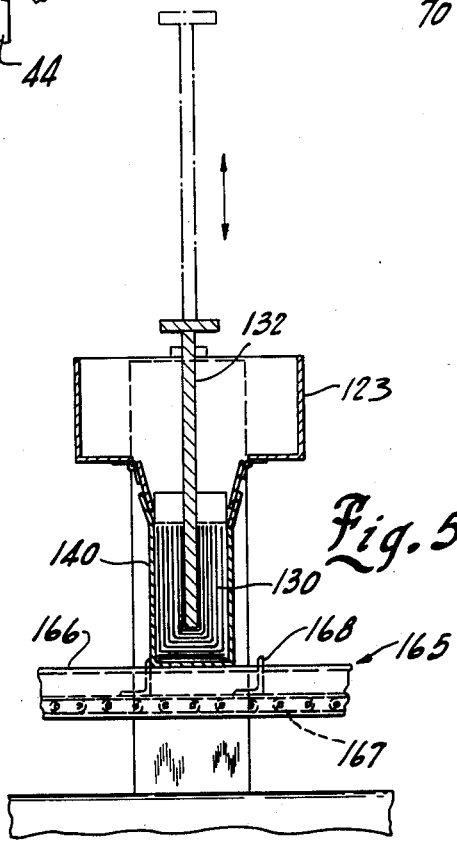
FIG. 5 is a view taken along the line 5—5 of FIG. 4 and illustrating the container loading system of the preferred embodiment of the invention.

Proceeding now to the description of FIG. 4, the mechanism for filling the boxes from the collectors is shown. The blade 132 is supported from a top bar 180, the ends of which are coupled to the ends of piston rods 182. The piston rods are part of pneumatic cylinders 184 which are located vertically adjacent collector 123 and are adapted to move the blade 132 from its elevated positon (full line) to its lowered position (dotted line). Cylinders 184 are attached to the conveyor frame 186, such as by angle brackets 187. A more detailed view of the blade 132, shown in its lowered position, is provided in FIG. 5.

Throughout the process of folding and conveying the bag products, they are maintained between sets of nylon ropes, thus insuring straight and square folds. The way in which all folds are made in a horizontal fashion while the bags are conveyed in a downward vertical direction allows the delivery of folded bags into the collecting trays, the counting thereof and the loading thereof into consumer package. The apparatus of this invention provides an extraordinary amount of flexibility in that the location of the folds, as well as the number of folds, can be varied widely to provide the capability of using the same machine for a variety of products.

While the present invention has been described in connection with a single preferred embodiment, the invention is not to be so limited, but it is to be limited solely by the scope of the claims which follow.

I claim:

1. A system for folding individually and subsequently packaging plastic bags comprising:

a plurality of rollers mounted in a frame, each of said rollers having a plurality of spaced-apart annular grooves in its surface adapted to receive endless rope means, said rollers including discrete groups of rollers spaced apart from one another and connected by a plurality of said rope means to form a conveying surface for said bags, said rollers being further arranged so that each bag is maintained between the conveying surfaces of adjoining groups of said rollers in a conveying path while said bad is within said folding system;

said folding system including a first linear conveying path, a second linear conveying path which is arranged perpendicularly to said first linear conveying path, and a third linear conveying path perpendicular to said second path and parallel to but spaced apart from said first path;

a first anvil means at the intersection of said first and second paths for periodically urging each of said bags from said first path to said second path while said bag is moving in said first path;

said folding system having an outlet for unfolded bags at the end of said first path and an outlet for once folded bags at the end of said second path; and said folding system also comprising means for driving selected ones of said rollers.

2. The invention set forth in claim 1 wherein said folding system further comprises a fourth linear conveying path arranged perpendicularly to said third path and a fifth path perpendicular to said fourth path and parallel to but spaced apart from said third path, a second anvil means at the intersection of said third and fourth paths for periodically urging each of said once folded bags from said third path to said fourth path while said once folded bag is moving in said third path, said folding system also including an outlet at the end of said fifth path for twice folded bags.

3. The invention set fourth in claim 2 wherein said folding system further comprises a sixth linear conveying path arranged perpendicularly to said fifth path and a seventh linear conveying path perpendicular to said sixth path and parallel to but spaced apart from said fifth path, a third anvil means at the intersection of said fifth and sixth paths for periodically urging each of said twice folded bags from said fifth path to said sixth path while said twice folded bag is moving in said fifth path, said folding system also including an outlet of the end of said seventh path for bags which have been folded three times in said folding system.

4. The invention set forth in claim 1 wherein said first anvil means comprises an elongate slotted edge and means for moving said edge from a first position in which said edge is displaced from said intersection of said first and second paths to a second position in which said edge is adjacent said intersection, said edge including a plurality of holes coupled to a source of compressed air, whereby movement of said edge from said first to said second position and a blast of air from said holes accomplishes said urging of said bag.

5. The invention set forth in claim 4 wherein said moving means comprises pneumatic cylinder means.

6. The invention set forth in claim 2 wherein said second anvil means comprises an elongate slotted edge and means for moving said edge from a first position in which said edge is displaced from said intersection of said third and fourth paths to a second position in which said edge is adjacent said intersection, said edge including a plurality of holes coupled to a source of compressed air, whereby movement of said air blast accomplishes said urging of said bag.

7. The invention set forth in claim 6 wherein said moving means comprises pneumatic cylinder means.

8. The invention set forth in claim 3 wherein said third anvil means comprises an elongate slotted edge and means for moving said edge from a first position in which said edge is displaced from said intersection of said fifth and sixth paths to a second position in which said edge is adjacent said intersection, said edge including a plurality of holes coupled to a source of compressed air, whereby movement of said edge from said first position to said second position and said air blast accomplishes said urging of said bag.

9. The invention set forth in claim 8 wherein said moving means comprises pneumatic cylinder means.

10. The invention set forth in claim 1 wherein said folding system further includes an inlet conveying path leading to said first path.

11. The invention set forth in claim 10 wherein said inlet path is formed by further rollers and spaced apart endless rope means and wherein the speed of said first linear conveying path is greater than the speed of said inlet path.

12. The invention set forth in claim 1 wherein said folding system also includes means for collecting bags from one of said outlets.

13. The invention set forth in claim 12 wherein said system further comprises additional conveyor means for moving a packaging container to the vicinity of said outlets.

14. The invention set forth in claim 1 wherein a plurality of collecting means are provided for strips discharged from said outlets.

15. The invention set forth in claim 2 wherein said folding system also includes means for collecting bags from one of said outlets.

16. The invention set forth in claim 15 wherein said system further comprises additional conveyor means for moving a packaging container to the vicinity of said outlets.

17. The invention set forth in claim 2 wherein a plurality of collecting means are provided for bags discharged from said outlets.

18. The invention set forth in claim 3 wherein said folding system also includes means for collecting bags from one of said outlets.

19. The invention set forth in claim 18 wherein said system further comprises additional conveyor means for moving a packaging container to the vicinity of said outlets.

20. The invention set forth in claim 3 wherein a plurality of collecting means are provided for bags discharged from said outlets.

21. A system for folding sheets of pliable material comprising:

a plurality of rollers mounted in a frame, each of said rollers having a plurality of spaced-apart annular grooves in its surface adapted to receive endless rope means, said rollers including discrete groups of rollers spaced apart from one another and connected by a plurality of said rope means to form a conveying surface for said pliable material, said rollers being further arranged so that said pliable material is maintained between the conveying surfaces of adjoining groups of said rollers in a conveying path while said sheet is within said folding system;

said folding system including a first linear conveying path, a second linear conveying path which is arranged perpendicularly to said first linear conveying path, and a third linear conveying path perpendicular to said second path and parallel to but spaced apart from said first path;

a first anvil means at the intersection of said first and second paths for periodically urging said pliable material from said first path to said second path while said sheet of pliable material is moving in said first path;

said folding system having an outlet for unfolded sheets of pliable material at the end of said first path and an outlet for once folded sheets of pliable material at the end of said second path;

said folding system also comprising means for driving selected ones of said rollers; and means for collecting pliable material from one of said outlets comprising a collector having side walls and a bottom formed by a pair of spring-loaded gate means, and wherein said gate means are spring-loaded to a position in which said gate means are perpendicular to said side walls.

22. The invention set forth in claim 21 wherein said system further comprises ram means adapted for movement between a first position above said collector means to a second postiion in which said ram extends through said collector and the bottoms thereof.

23. The invention set forth in claim 21 wherein said folding system further comprises a fourth linear conveying path arranged perpendicularly to said third path and a fifth path perpendicular to said fourth path and parallel to but spaced apart from said third path, a second anvil means at the intersection of said third and fourth paths for periodically urging said once folded sheet of pliable material from said third path to said fourth path while said once folded sheet of pliable material is moving in said third path, said folding system also including an outlet at the end of said fifth path for twice folded sheets of pliable material;

wherein said collecting means is additionally capable of collecting pliable material from said outlet of said fifth path.

24. The invention set forth in claim 23 wherein said system further comprises ram means adapted for movement between a first position above said collector means to a second position in which said ram extends through said collector and the bottom thereof.

25. The invention set forth in claim 23 wherein said folding system further comprises a sixth linear conveying path arranged perpendicularly to said fifth path and a seventh linear conveying path perpendicular to said sixth path and parallel to but space apart from said fifth path, a third anvil means at the intersection of said fifth and sixth paths for periodically urging said twice folded sheet of pliable material from said fifth path to said sixth path while said twice folded sheet of pliable material is moving in said fifth path, said folding system also including an outlet at the end of said seventh path for sheets of pliable material which have been folded three times in said folding system;

wherein said collecting means is additionally capable of collecting pliable material from said outlet of said seventh path.

26. The invention set forth in claim 25 wherein said system further comprises ram means adapted for movement between a first position above said collector means to a second position in which said ram extends through said collector and the bottom thereof.

27. A system for folding plastic bags, collecting said folded bags in a stack and for loading said stack of folded bags into a packaging container comprising:

a folder section which includes a plurality of rollers mounted in a frame, groups of said rollers being interconnected to one another by spaced-apart endless rope means and means for driving certain of said rollers, folding anvil means in said folder section to form at least one fold in each of said bags as it is being transported through said folder section, said folder having at least one outlet for folded bags;.

a plurality of collecting means located in the vicinity of and generally below said outlets;

means for discharging folded bags from said collecting means through the bottom thereof; and conveying means for moving one or more packaging containers beneath said collecting means to receive said discharged stack of bags.

28. The invention set forth in claim 27 where each of said collecting means comprises a box means having a vertical side walls and a bottom, said bottom comprising a pair of spring-loaded gate plate means, said plate means being spring-loaded to a first position in which said plate means are perpendicular to said side walls and a second position in which said plate means extend downwardly to form an opening in the bottom of said collecting means.

29. The invention set forth in claim 28 wherein said discharging means comprises a ram means, said ram means being disposed above said collecting means when in a first position and disposed through said collecting means when in a second position.

30. The invention set forth in claim 29 comprising means for moving said ram from said first to said second position, said means comprising pneumatic cylinder means.

31. The invention set forth in claim 27 wherein said conveying means comprises a three-section conveyor, a first conveying section being a continuous conveyor for empty packaging containers, a second conveying section comprising an indexing conveyor adapted to receive packaging containers from said first conveyor and to move said packaging containers to said third conveying section, said third conveying section being an indexing conveyor and adapted to selectively position said packaging containers beneath said collecting means.

32. The invention set forth in claim 27 wherein said system further includes a pivotable slide means for selectively directing bags to alternate ones of said collecting means, pneumatic cylinder means coupled to said slide means to move said slide means.

* * * * *

UNITED STATES PATENT AND TRADEMARK OFFICE

CERTIFICATE OF CORRECTION

PATENT NO. : 4,624,095

DATED : November 25, 1986

INVENTOR(S) : Peter J. Gietman, Jr.

It is certified that error appears in the above-identified patent and that said Letters Patent is hereby corrected as shown below:

Claim 1, Column 9, Line 37, change "bad" to --bag--

Claim 3, Column 9, Line 64, change "fourth" to --forth--

Claim 22, Column 11, Line 55, change "postiion" to --position--

Signed and Sealed this

Third Day of March, 1987

*Attest:*

DONALD J. QUIGG

*Attesting Officer*

*Commissioner of Patents and Trademarks*